US005675369A

United States Patent [19]

Gaskill

[11] Patent Number: 5,675,369

[45] Date of Patent: Oct. 7, 1997

[54] TWO-SIDED COLOR PRINTING APPARATUS AND REVERSIBLE PRINT HEAD MOUNTING ASSEMBLY THEREFOR

[75] Inventor: David M. Gaskill, Providence, R.I.

[73] Assignee: Astro-Med, Inc., West Warwick, R.I.

[21] Appl. No.: 461,392

[22] Filed: Jun. 5, 1995

[51] Int. Cl.[6] ..... B41J 2/325

[52] U.S. Cl. ..... 347/171; 347/173

[58] Field of Search ..... 347/171, 173, 347/172, 174, 175, 198, 176, 197; 400/120.01, 120.02, 120.03, 120.04, 82, 120.16, 120.17

[56] References Cited

U.S. PATENT DOCUMENTS

| | | | |
|---|---|---|---|
| 4,410,897 | 10/1983 | Moriguchi et al. | 347/173 |
| 4,811,036 | 3/1989 | Gaskill et al. | 347/173 |
| 4,857,941 | 8/1989 | Kaida | 347/175 |
| 5,486,057 | 1/1996 | Skinner et al. | 347/173 |

*Primary Examiner*—Huan H. Tran
*Attorney, Agent, or Firm*—Salter & Michaelson

[57] ABSTRACT

Thermal printing apparatus is operable for applying images to opposite first and second sides of a continuous strip. The apparatus includes first, second, third and fourth thermal printing assemblies actuatable for applying first, second, third and fourth images to the continuous strip at first, second, third and fourth printing stations. The first and third thermal printing assemblies are mounted on reversible mounting assemblies capable of mounting the respective thermal printing assembly in a first position wherein the printing assembly is actuable for applying an image to a first side of the strip, and a second position wherein the printing assembly is actuable for applying an image to a second side of the strip. The apparatus further includes a drive assembly including a rotatable drive roller for longitudinally advancing said strip so that passes through the printing assemblies, a stepping motor rotatable at a predetermined fixed rate of stepped rotational increments per revolution for rotating the drive roller to advance said strip, and a controller responsive to a predetermined number of stepped rotational increments of the stepping motor corresponding to a predetermined distance between the printing assemblies for actuating the printing assemblies to apply images to the first and second sides of the strip.

7 Claims, 4 Drawing Sheets

TWO-SIDED COLOR PRINTING APPARATUS AND REVERSIBLE PRINT HEAD MOUNTING ASSEMBLY THEREFOR

BACKGROUND AND SUMMARY OF THE INVENTION

The instant invention relates to apparatus for printing on two sides of a continuous strip, and more particularly to a two-sided printing apparatus which is capable of printing in multiple colors on two sides of a continuous strip.

Two-sided thermal printing apparatus have heretofore been known in the art. In this regard, the U.S. Pat. No. 4,811,036 to Gaskill et al represents the closest prior art to the subject invention of which the applicant is aware. The Gaskill patent discloses a printing apparatus operative for applying images to opposite sides of a continuous strip at first and second sequential printing stations. The first printing station is operative for applying a single color image (usually black) to the lower side of the strip, and the second printing station is operative for applying a single color image to the upper side of the strip. The apparatus further includes a feed assembly driven by a stepping motor for advancing the continuous strip from the first printing station to the second printing station and a controller responsive to a predetermined number of stepped rotational increments of the stepping motor for coordinating the printing operations at the first and second printing stations. While the above-described apparatus is effective for applying single color images to each of the opposite surfaces of the strip, the apparatus is not capable of printing multiple-color images on either side of the strip.

The instant invention provides a thermal printing apparatus operable for applying multiple-color images to opposite first and second sides of a continuous strip. The apparatus includes first, second, third and fourth thermal printing assemblies actuatable for applying first, second, third and fourth images to the continuous strip at first, second, third and fourth printing stations. The first and third thermal printing assemblies include reversible mounting hardware for reversibly mounting the respective thermal printing assembly in a first position wherein the printing assembly is actuable for applying an image to a first side of the strip, and a second position wherein the printing assembly is actuable for applying an image to a second side of the strip. Typically, three of the printing assemblies, usually the second third and fourth printing assemblies, are mounted in the first position for printing three separate color images to the first side of the strip whereby a multiple-color image is created on the first side of the strip. The first printing assembly is usually mounted in the second position for printing a black and white image onto the back, or second side of the strip. The device is thus useful for printing labels or tags having a color image on one side thereof, and a black and white bar code, and/or pricing and/or size information on the reverse side. The apparatus further includes a drive assembly including a rotatable drive roller for longitudinally advancing said strip so that passes through the printing assemblies, a stepping motor rotatable at a predetermined fixed rate of stepped rotational increments per revolution for rotating the drive roller to advance said strip, and a controller responsive to a predetermined number of stepped rotational increments of the stepping motor corresponding to a predetermined distance between the printing assemblies for actuating the printing assemblies to apply images to the first and second sides of the strip. The stepping motor and controller ensure proper longitudinal alignment of the printed images on the first and second sides of the strip.

Accordingly, among the objects of the instant invention are: the provision of printing apparatus for applying a multiple-color image to one side of a continuous strip while also applying a single or multiple color image to a second side of the strip; and the provision of printing apparatus having multiple reversible print heads for printing on either of two opposite sides of a continuous strip.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
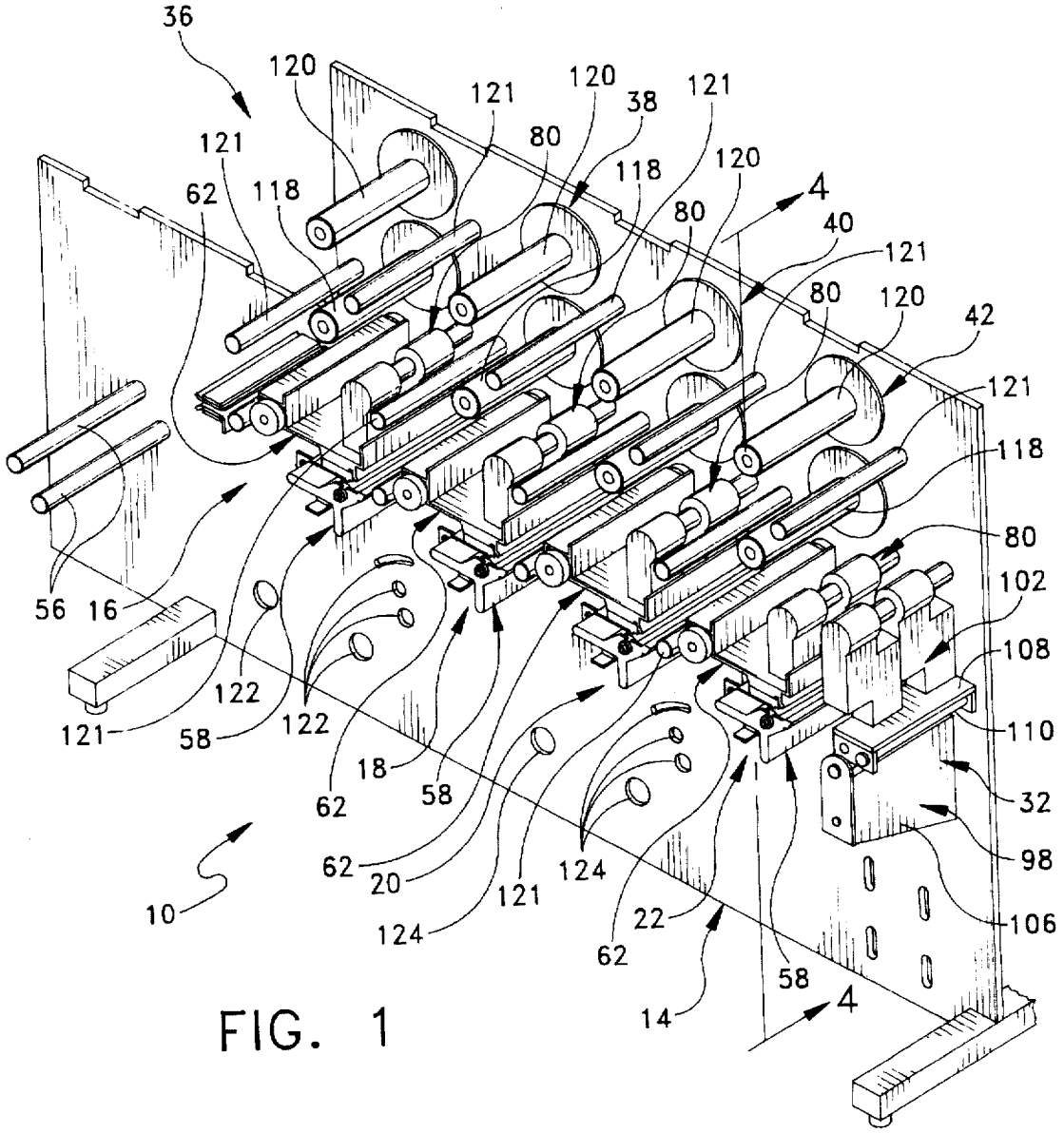
FIG. 1 is a perspective view of the apparatus of the instant invention.

Referring now to the drawings, the printing apparatus of the instant invention is illustrated and generally indicated at 10 in FIGS. 1–5. As will hereinafter be more fully described, the instant thermal printing apparatus 10 is operable for printing multiple thermal images onto the opposite first and second sides of a continuous strip of print media 12.

The apparatus 10 includes a back plate generally indicated at 14, first, second, third and fourth printing assemblies generally indicated at 16, 18, 20, and 22 respectively, operable at first, second, third, and fourth printing stations 24, 26, 28, and 30 respectively for Printing first, second, third and fourth images onto the strip 12, and a feed assembly generally indicated at 32 for drawing the strip 12 through the printing stations.

Figure 2:
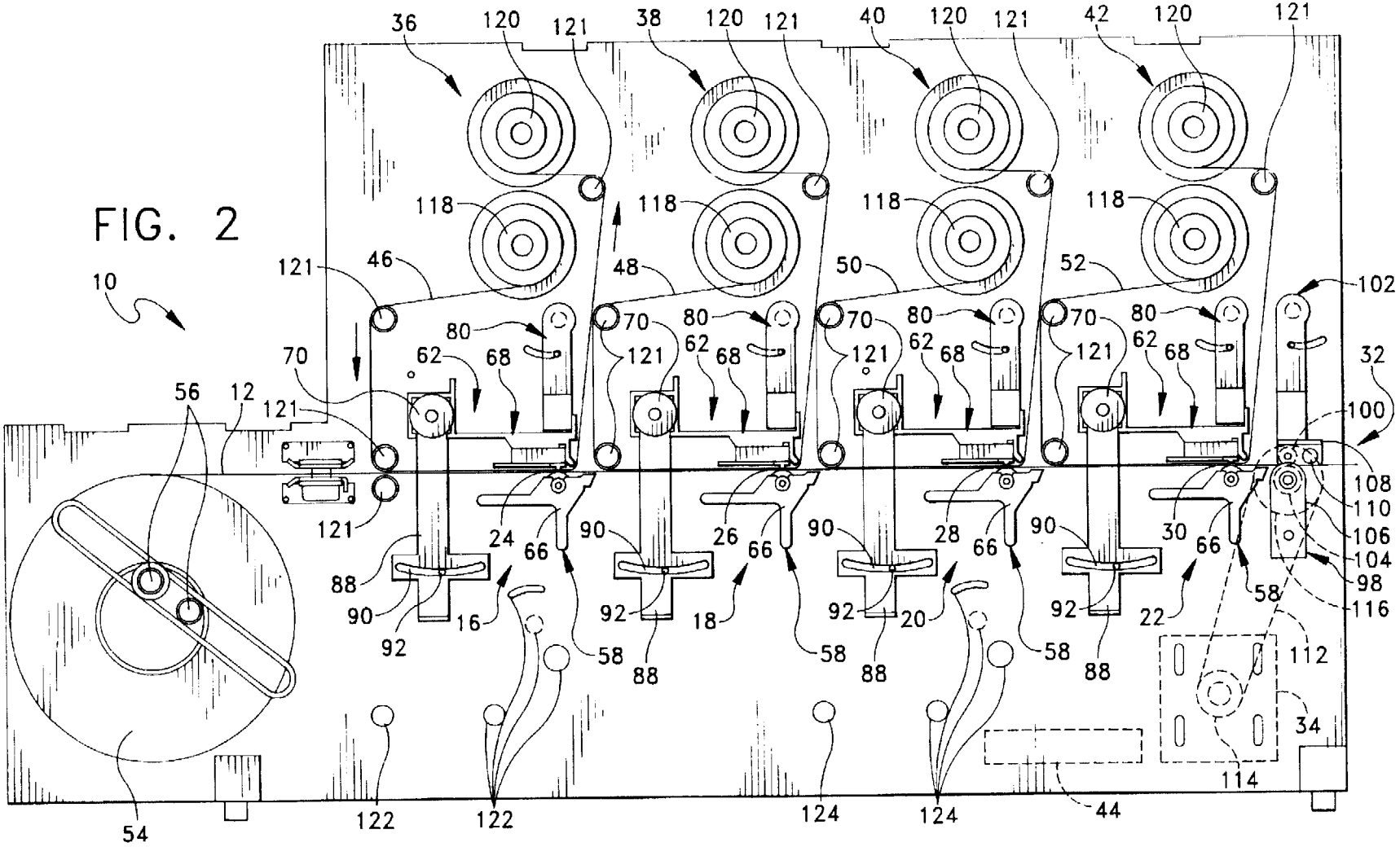
FIG. 2 is a front elevational view thereof.

The apparatus 10 further includes a stepping motor 34 (broken lines FIG. 2), first, second, third and fourth printing film drive assemblies generally indicated at 36, 38, 40 and 42 respectively, and a controller 44 (broken lines (FIG. 2). During operation of the apparatus 10, the printing film drive assemblies 36, 38, 40, 42 are operated to supply first, second, third and fourth printing films 46, 48, 50, 52 respectively, to the printing stations 24, 26, 28, 30, and the stepping motor 34 is operated to advance the strip 12 in a substantially taut disposition between the printing stations. The controller 44 is responsive to a predetermined number of stepped rotational increments of the stepping motor 34 for controlling the printing assemblies 16, 18, 20, 22 to apply images to the opposite sides of the strip 12 so that the longitudinal positions of the images are precisely coordinated throughout the longitudinal extent of the strip 12.

The strip 12 preferably comprises a continuous strip of a paper or non-woven substrate having a width of between 1 and 4 inches. The strip 12 is preferably provided in a continuous roll 54 which is mounted on brackets 56 mounted to the back plate 14.

Figure 3:
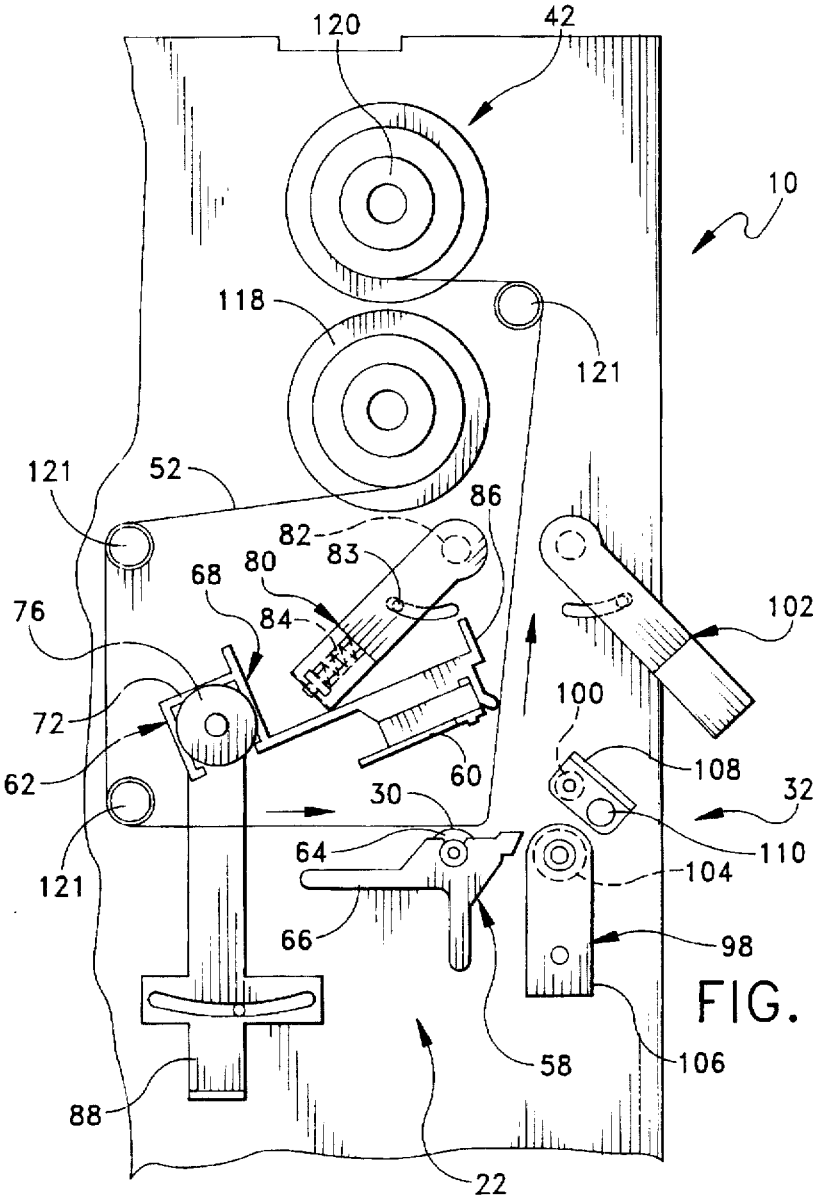
FIG. 3 is an enlarged fragmentary elevational view of a single print station assembly and the drive assembly thereof.
Figure 4:
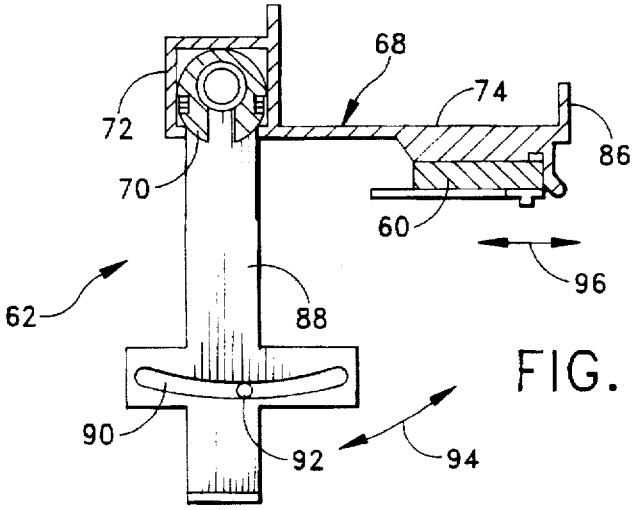
FIG. 4 is a cross-sectional view taken along line 5—5 of FIG. 1.

Referring now to FIGS. 2–4, the printing assemblies 16, 18, 20, 22 are more clearly illustrated. Printing assembly 22 comprises a platen assembly generally indicated at 58, a thermal print head 60, and a thermal print head mounting assembly 62. The platen assembly comprises a cylindrical platen 64 having a rubberized outer shell, and a platen mounting bracket 66 which is operative for rotatably receiving the platen 64 in parallel relation to the print head. The mounting bracket 66 is mounted to the back plate as illustrated in FIGS. 1–3. The print head 60 preferably comprises a conventional thermal print head having an array of discretely energizable thermal elements. Energizing of the thermal elements is controlled by the controller 44 through conventional cable means (not shown).

The print head mounting assembly 62 is operative for mounting the print head 60 in substantially parallel relation to the platen 64 so that it is movable between an actuated position (FIG. 2) wherein the print head 60 is positioned in biased engagement with the platen 64, and an unactuated position (FIG. 3) wherein the print head 60 is lifted out of engagement with the platen 64. The print head mounting assembly 62 (see FIG. 4) comprises a mounting bar generally indicated at 68, and a pivot bar 70. The mounting bar 68 includes a C-shaped channel portion 72 which is slidably received over the pivot bar 70, and an arm portion 74 which extends outwardly from the channel portion 72 and receives the print head 60 at the terminal end thereof. A cap 76 is received at the end of the pivot bar 70 for maintaining the mounting bar 68 on the pivot bar 70. The mounting bar 68 is thus pivotably movable about the pivot bar 70 for moving the print head 60 into and out of engagement with the platen 64. The print head mounting assembly 62 further comprises a pivotable toggle element generally indicated at 80 for maintaining the print head 60 in biased engagement with the platen 64. The toggle element 80 is pivotably mounted to the back plate 14 on a pin 82 at one end thereof while the opposite end is pivotably movable into engagement with the terminal end of the arm portion 74 of the mounting bar 68. Movement of the toggle element is guided by pin 83. More specifically, the toggle element 80 further includes a spring element 84 (broken lines) which actually engages the upper surface of the mounting bar 68. In this regard, the spring element 84 urges the print head mounting assembly 62 downwardly into biased engagement with the platen 64. The terminal end of the mounting bar includes a flange 86 for limiting forward movement of the toggle element 80. Referring now to FIG. 4, a means is provided for adjusting the longitudinal position of the print head 60 with respect to the platen 64. In this regard, the pivot bar 70 has a cam shape as illustrated in FIG. 4. Attached to the end of the pivot bar 70 adjacent to the back plate 14 is an actuator bar 88. The terminal end of the actuator bar 88 includes an arcuate slot 90 which is received over a guide pin 92 for guiding pivot movement of the actuator bar 88. In use, pivoting movement (arrow 94) of the actuator bar 88 rotates the cam-shaped pivot bar 70 causing the mounting bar 68 to move forward or backward (arrow 96).

The first, second, and third printing assemblies 16, 18, 20, respectively, are identical to the first printing assembly 22 described hereinabove, and hence will not be described separately. As illustrated in FIGS. 1 and 2, the first, second, third and fourth printing assemblies 16, 18, 20, 22 are mounted to the back plate 14 so that they are operative for applying four separate images to the first or upper side of the strip 12. However, as will be described hereinafter, the first and third printing assemblies 16 and 20 can be reversibly mounted so that either or both are operative for applying images to the second or underside of the strip 12 while the second and fourth printing assemblies 18, 22 are still operative for applying images to the upper side of the strip 12.

Referring back to FIG. 3, the feed assembly 32 is operative for advancing the strip 12 through the apparatus 10 so that it passes through the first, second, third and fourth printing stations 24, 26, 28, 30. More specifically, the feed assembly 32 comprises a drive assembly 98, a pressure roller 100, and a toggle element 102 for urging the pressure roller 100 into pressured engagement with the drive roller assembly 98. The drive assembly 98 comprises a drive roller 104 having a rubberized outer shell, and a mounting bracket 106 for mounting the drive roller 104 to the back plate 14. The pressure roller 100 includes a rubberized outer shell, and it is rotatably mounted in a bracket 108 which is pivotably mounted to the back plate 14 on a pivot pin 110. The toggle element 102 is substantially identical to the previously described toggle elements 80 and it is pivotably movable for urging the pressure roller 100 into biased engagement with the drive roller 104 so that when the drive roller 104 is rotated, the rollers 100, 104 cooperate for advancing the strip 12 through the apparatus 10.

The stepping motor 34 (FIG. 2) is drivingly coupled to the drive roller 104 via a drive belt 112 and pulley 114, 116 attached to the stepping motor 34 and drive roller 104. The stepping motor 34 is operative at a uniform rate of stepped rotational increments per revolution in order to insure precise longitudinal orientation of the different images applied to opposite sides of the strip 12 at the printing stations 24, 26, 28, 30.

The first, second, third and fourth printing film drive assemblies 36, 38, 40, 42 are operative for advancing their respective printing films 46, 48, 50, 52 through the respective printing stations 24, 26, 28, 30, so that the printing films pass between the respective print head 60 and the strip 12. The printing films 46, 48, 50, 52 comprise conventional thin polyester films having heat sensitive coatings thereon, and they are responsive to heat from the thermal print heads 60 for transferring selected portions of the coatings thereon onto the strip 12 to apply images to the strip 12. The printing films each preferably have a width of about 1 to 4 inches. The film drive assemblies 36, 38, 40, 42 each comprise a film supply hub 118 containing a supply of film, and a film take-up hub 120 and several guide rolls 121 for guiding the films into proper alignment into the printing station. The supply hubs 118 are rotatably mounted to the back plate 14 and include a resistance mechanism (not shown) for applying a slight resistance to rotation of the hub 118 in order to maintain the films in a substantially taut condition as they are passed through the respective print station. The take-up hubs 120 are also rotatably mounted to the back plate 14 and they are drivingly coupled to drive motors (not shown) through conventional slip clutch mechanisms (not shown). During operation of the apparatus 10, the drive motors are operated to rotate the take-up hubs 120 in order to advance the films through the printing stations. However, the slip clutches are designed so that they increasingly slip as the wound diameters of the take-up hubs 120 are increased in order to maintain substantially constant film speeds throughout the printing processes.

The controller 44 is operable in a conventional manner and includes a programmable microprocessor which can be programmed for control of the stepping motor 34, thermal print heads 60, and the printing film drive assemblies 36, 38, 40, 42. More specifically, the controller 44 is programmed so that it is responsive to a predetermined number of stepped rotational increments of the stepping motor 34 for coordinating the energizations of the print heads 60 in the printing assemblies 16, 18, 20, 22. The controller 44 actuates the first printing assembly 16 to apply a first image to the strip 12 at the first printing station 24, and then for actuating the second printing assembly 18 for applying an image to the strip 12 at the second printing station 26 after a predetermined number of stepped rotational increments of the stepping motor 34 which corresponds to the distance between the two printing stations 24, 26. The controller further controls the third and fourth printing assemblies 20, 22 for similarly applying third and fourth images to the strip 12. In other words, the controller 44 sequentially coordinates the longitudinal positions of the images on the strip 12. The controller 44 is also operative for controlling the printing film drive assemblies 36, 38, 40, 42 so that the films 46, 48, 50, 52 are passed through the printing stations 24, 26, 28, 30 as the strip 12 is advanced.

Figure 5:
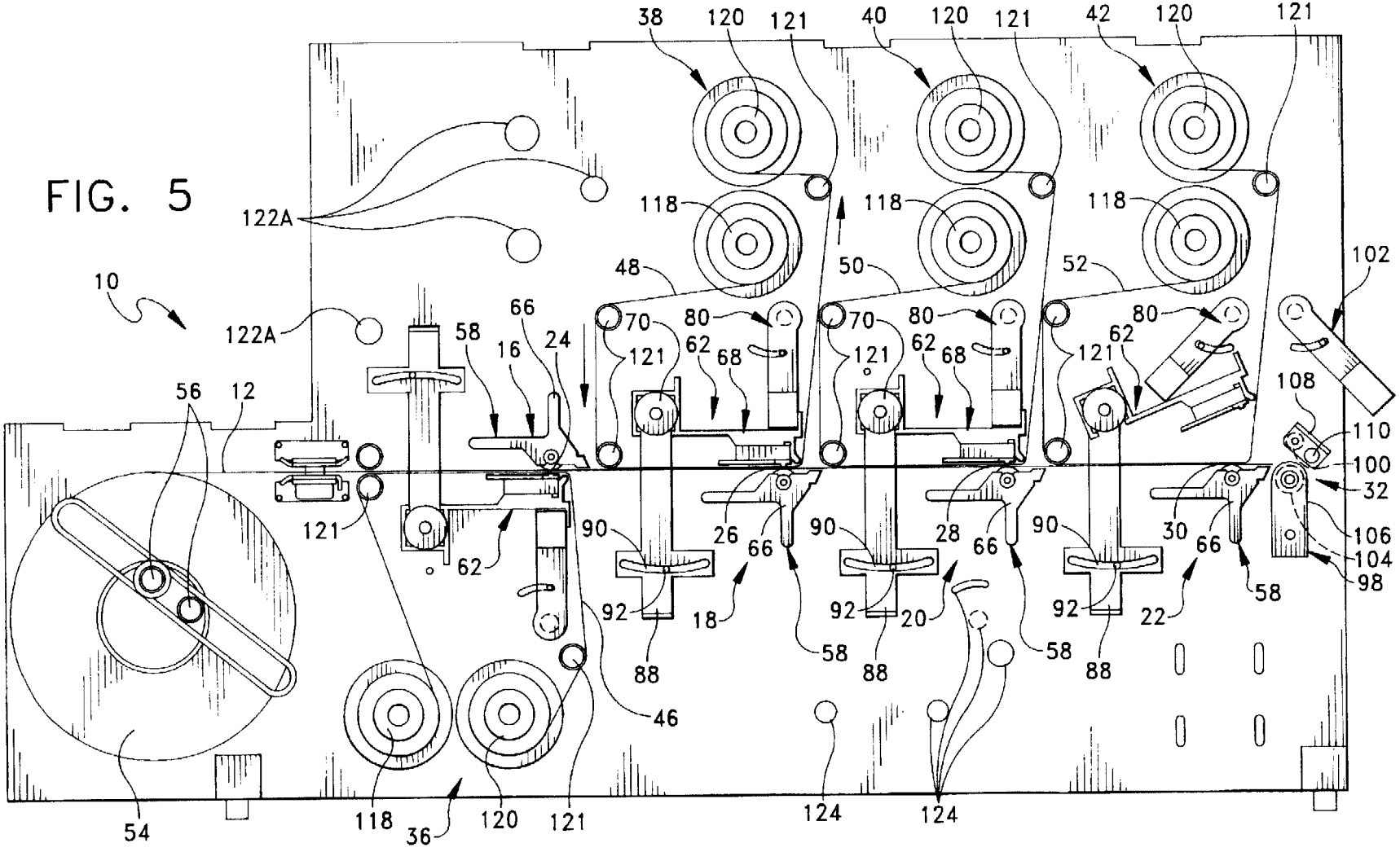
FIG. 5 is a front elevational view thereof with one of the print station assemblies reversed for printing on the opposite side of the continuous print media.

Referring now to FIG. 5, the first printing assembly 16 and printing film drive assemly 36 are illustrated in a reversed mounting position wherein the first printing assembly 16 is now operative for applying an image to the second or underside of the strip 12. In this connection, the back plate 14 is provided with appropriate mounting apertures 122 for receiving the components of the print head mounting assembly 62, as well as the hubs 118, 120 and guide rollers 121 of the printing film drive assembly 36. Apertures 122A indicate the positions where the print head mounting components and printing film drive components are attached when mounted in the first position. It can further be seen that the third printing station 28 is also provided with appropriate mounting apertures 124 for reverse mounting of the third printing assembly 20 and printing film drive assembly 40. In this regard, it can be seen that the first and third printing assemblies 16, 20 are operative for applying images to either the upper or lower side of the strip 12. Accordingly, multicolor images can be applied to either or both sides of the strip 12. However, in most applications, one of the printing assemblies (usually the first, i.e. 16) is reverse mounted for applying a black and white image to the lower side of the strip 12 while the remaining three printing assemblies 18, 20, 22 are mounted for applying several overlying color images to the upper side of the strip 12. Such an application is highly useful in the garment industry for printing clothing labels or tags having a color company logo on one side thereof while having black and white bar code, sizing and pricing information on the reverse side thereof. The apparatus 10 has further been found to be cost effective and efficient for printing small batches of the labels or tags for specialty clothing outfits wherein the prior methods of printing such labels required offset printing in large numbers to achieve any kind of cost effectiveness.

It can therefore be seen that the instant invention provides a novel and effective apparatus 10 for applying multiple images to either or both upper and lower sides of a continuous strip of print media 12. The apparatus 10 includes four printing assemblies 16, 18, 20, 22 which are individually operable for applying an image to the surface of the strip 12. In one type of set-up, all four printing assemblies 16, 18, 20, 22 are mounted for applying images to a single side of the strip 12. However, the first and third printing assemblies 16, 20 are reversible so that either one or two images can be applied to the underside of the strip 12. The apparatus 10 thus allows for the printing of multiple images on the upper side of the strip 12, while simultaneously allowing the printing of an image onto the underside of the strip 12. The multiple image printing of the apparatus 10 combined with the reversibility of two of the printing assemblies 16, 20 makes it highly effective for printing labels and tags for the garment industry, as well as other applications in the retail industry. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. An apparatus for applying images to opposite first and second sides of a continuous strip comprising:

printing means actuable for applying an image to a continuous strip of print media at a printing station, said printing means comprising a rotatable platen, and a thermal print head mounted for biased, engagement with said platen, said continuous strip passing intermediate said thermal print head and said platen, and further comprising a thermal printing film passing intermediate said continuous strip and said thermal print head;

means for mounting said printing means in a first mounting position wherein said printing means is actuable for applying an image to a first side of said continuous strip;

means for mounting said printing means in a second mounting position wherein said printing means is actuable for applying an image to a second side of said continuous strip; and drive means for longitudinally advancing said continuous strip through said printing station.

2. In the apparatus of 1, said print head being pivotably movable between a printing position wherein said print head is in engagement with said platen and an idle position wherein said print head is out of engagement with said platen, and further including a toggle element for urging said print head into biased engagement with said platen when in said printing position.

3. In the apparatus of claim 1, said printing means including means for adjusting a longitudinal position of said print head with respect to said platen.

4. An apparatus for applying images to opposite first and second sides of a continuous strip comprising:

first printing means actuable for applying an image to a first side of a continuous strip of print media at a first printing station;

second printing means actuable for applying an image to said continuous strip of print media at a second printing station;

means for mounting said second printing means in a first mounting position wherein said second printing means is actuable for applying an image to the first side of said strip;

means for mounting said second printing means in a second mounting position wherein said second printing means is actuable for applying an image to the second side of said strip; and drive means for longitudinally advancing said strip through said first and second printing stations.

5. In the apparatus of claim 4, said first and second printing means each comprising a rotatable platen, and a thermal print head mounted for biased engagement with said platen, said strip passing intermediate said thermal print head and said platen, and further comprising a thermal printing film passing intermediate said strip and said thermal print head.

6. In the apparatus of claim 5, said print head being pivotably movable between a printing position wherein said print head is in engagement with said platen and an idle position wherein said print head is out of engagement with said platen, and further including a toggle element for urging said print head into biased engagement with said platen when in said printing position.

7. In the apparatus of claim 5, said printing means including means for adjusting a longitudinal position of said print head with respect to said platen.

* * * * *